US011479887B2

(12) United States Patent
Khu

(10) Patent No.: US 11,479,887 B2
(45) Date of Patent: Oct. 25, 2022

(54) APPARATUS FOR PRODUCING A BRAIDED COVERING

(71) Applicant: Peter Khu, Vienna (AT)

(72) Inventor: Peter Khu, Vienna (AT)

( * ) Notice: Subject to any disclaimer, the term of this patent is extended or adjusted under 35 U.S.C. 154(b) by 0 days.

(21) Appl. No.: 17/267,700

(22) PCT Filed: Aug. 9, 2019

(86) PCT No.: PCT/EP2019/071444
§ 371 (c)(1),
(2) Date: Feb. 10, 2021

(87) PCT Pub. No.: WO2020/035412
PCT Pub. Date: Feb. 20, 2020

(65) Prior Publication Data

US 2021/0292942 A1 Sep. 23, 2021

(30) Foreign Application Priority Data

Aug. 16, 2018 (AT) ..... A 50696/2018

(51) Int. Cl.
*D04C 3/42* (2006.01)
*D04C 3/16* (2006.01)

(52) U.S. Cl.
CPC *D04C 3/42* (2013.01); *D04C 3/16* (2013.01)

(58) Field of Classification Search
CPC ..... D04C 3/42; D04C 3/16
See application file for complete search history.

(56) References Cited

U.S. PATENT DOCUMENTS 1,409,298 A * 3/1922 Horn ..... D04C 3/00 87/45
2,413,930 A * 1/1947 Smith ..... D01H 7/60 57/119

(Continued)

FOREIGN PATENT DOCUMENTS

EP 441604 A1 8/1991
EP 2405045 A1 1/2012

(Continued)

OTHER PUBLICATIONS

International Search Report and Written Opinion of the International Searching Authority; Application No. PCT/EP2019/071444; Completed: Nov. 15, 2019; dated Nov. 22, 2019; 14 Pages.

*Primary Examiner* — Shaun R Hurley
(74) *Attorney, Agent, or Firm* — Whitmyer IP Group LLC

(57) ABSTRACT

A device for producing a braided sheath around an elongate object. The device has a warp thread frame which rotates in a warp thread rotation direction about a machine axis and has a group of warp thread bobbins, and the device has a group of bobbin carriers which rotate in the opposite direction about the machine axis and each have at least one weft thread bobbin. At least one warp thread is guided from each warp thread bobbin to a braiding point and at least one weft thread is guided from each weft thread bobbin to the braiding point. The course of the warp thread can be shifted alternately above and below the weft thread rotating past in the opposite direction via a laying means. The device has a bobbin carrier support which rotates with the warp thread frame in the warp thread rotation direction during operation.

8 Claims, 3 Drawing Sheets

(56) References Cited

U.S. PATENT DOCUMENTS

| | | | | | |
|---|---|---|---|---|---|
| 2,672,071 | A * | 3/1954 | Marogg | D04C 3/00 | 87/46 |
| 3,892,161 | A * | 7/1975 | Sokol | D04C 3/42 | 87/29 |
| 5,099,744 | A * | 3/1992 | Hurst | D04C 3/16 | 87/45 |
| 5,749,280 | A * | 5/1998 | Scherzinger | D04C 3/42 | 87/45 |
| 5,787,784 | A * | 8/1998 | Scherzinger | D04C 3/42 | 87/45 |
| 6,694,855 | B1 * | 2/2004 | Emmerich | D04C 3/42 | 87/44 |
| 2012/0006187 | A1 * | 1/2012 | Emmerich | D04C 3/46 | 87/50 |
| 2015/0299916 | A1 * | 10/2015 | Reinisch | D04C 3/44 | 87/3 |
| 2017/0298546 | A1 * | 10/2017 | Reinisch | D04C 3/48 | |

FOREIGN PATENT DOCUMENTS

| | | | |
|---|---|---|---|
| GB | 217635 | A | 6/1924 |
| WO | 03064747 | A1 | 8/2003 |
| WO | 2016045987 | A1 | 3/2016 |

* cited by examiner

APPARATUS FOR PRODUCING A BRAIDED COVERING

TECHNICAL FIELD

The present teaching relates to a device for producing a braided sheath around an elongate object, the device having a warp thread frame which rotates in a warp thread rotation direction about a machine axis and has a group of warp thread bobbins, and having a group of bobbin carriers which rotate in the opposite direction about the machine axis and each have at least one weft thread bobbin, with at least one warp thread being guided from each warp thread bobbin to a braiding point, and at least one weft thread being guided from each weft thread bobbin to the braiding point, and it being possible to shift the course of the warp thread alternately above and below the weft thread rotating past in the opposite direction via a laying means.

BACKGROUND

Devices of this kind have already been described in detail in the prior art, for example in EP 0441604 A1 or EP 2408045 A1.

The bobbin carriers of the device disclosed in EP 2408045 A1 have a slide which is guided in a circular guide track formed by an inner roller ring and an outer roller ring. The roller rings are arranged on a support plate in which slots are provided which receive the warp threads in the lower position so that the relevant bobbin carrier with the weft thread can be guided past above. The bobbin carriers are driven by gears which are also arranged on the support plate. The support plate rotates with the warp thread frame so that the slots are always aligned with the corresponding warp threads. The slides arranged in the guide track must be radially guided both externally, to absorb the centrifugal force, and also internally. Furthermore, the slides must be guided axially due to their own weight and the weight of the bobbin carriers. In practice, it has been found that pure rolling cannot be achieved even with this type of guidance. In particular, sliding friction occurs at the edges of the slides, which must be provided in order to absorb the axial forces, which leads to heating and considerable wear and reduces the rotational speeds that can be achieved.

The use of plain bearings along which the bobbin carriers are guided is also known in the prior art, but the problems of heat development and wear are even more pronounced. Such plain bearings also require large amounts of lubricants, which can contaminate the braided sheath produced.

SUMMARY

It is one object of the present teaching to overcome the disadvantages of the prior art. In particular, according to the present teaching, a dry-running device for producing a braided sheath is to be provided, so that no lubricants are required. This is required for cable sheathing in hospital environments, for example.

These and other objects are achieved according to the present teaching by a device of the type mentioned at the outset, which has a bobbin carrier support rotating with the warp thread frame in the warp thread rotation direction during operation, the bobbin carriers being mounted on the bobbin carrier support when the machine is at a standstill and the bobbin carrier being dimensioned so that the bearing force on the bobbin carrier support becomes zero when a specified speed is exceeded. The specified speed can either correspond to the operating speed or be lower. This makes it possible to realize substantially contact-free "floating" of the bobbin carrier over the bobbin carrier support when the specified speed is exceeded (i.e. in particular also at the operating speed). This means that there is no friction between the bobbin carrier and the bobbin carrier support, and no lubrication is required. The bobbin carrier slides on the bobbin carrier support for a short time, simply to start up the device, until the lowest specified speed is reached at which the bearing force becomes zero.

At the end closest to the machine axis, the bobbin carrier can advantageously have a guide surface which is oriented in the centrifugal direction and which is mounted on a roller ring consisting of guide rollers which are arranged on a roller carrier plate. A single roller ring on which the guide surface is mounted is sufficient, since no forces in the axial direction and no tilting moments have to be transmitted between the roller ring and the guide surface. The guide surface can be curved in one or two directions according to the outer profile of the guide rollers. The roller ring only has to apply a radial force directed inward toward the machine axis to the bobbin carrier, which counteracts the force resulting from weight force and centrifugal force. Weight force and centrifugal force are in a constant ratio to one another at a specified speed. Therefore, the fact that the direction of the resulting force does not change when the weight of the weft thread bobbin decreases as the weft thread is unwound can be exploited as long as the speed of rotation of the bobbin carriers remains the same. Only the center of gravity of the bobbin carrier can shift in the process, but the effects of this can be minimized by design. Alternatively, in a functional reversal, at the end of the bobbin carrier closest to the machine axis there can be guide rollers which project downward or upward and which are in engagement with corresponding guide surfaces arranged in a ring-like manner and rotating along with the warp thread frame.

As long as the line of action of the resulting force passes through the region in which the guide surface abuts the roller ring, the forces can be kept in equilibrium. In the case of cylindrical rollers and a guide surface which is straight (in cross-section), a speed range results in which the guide surface abuts the outer contour of the cylinders and the resulting force is in equilibrium with the centripetal force.

The guide rollers can advantageously have a convex or concave outer contour. This can cause "punctiform" contact between the guide surface and the roller ring, whereby the position of the contact point shifts depending on the line of action of the resulting force and automatically moves into a region of a force equilibrium. This allows the balance of forces between centrifugal force, weight force and centripetal force to be maintained over a wide range of speeds.

In an advantageous embodiment, the bobbin carriers can have a bobbin carrier shoe on which a bobbin carrier drive engages, and a bobbin carrier body which holds the weft thread bobbin. The bobbin carrier shoe can simultaneously form the sliding surface, which is mounted on a bearing surface of the bobbin carrier support during standstill and slides on this bobbin carrier support during start-up (i.e., before the specified speed is reached). As soon as the specified speed is reached, the bearing force drops to zero, so that an air gap is formed between the sliding surface and the bearing surface of the bobbin carrier support and no more sliding friction occurs.

Advantageously, the bobbin carrier shoe and the bobbin carrier body can be interconnected such that they can be shifted in the centrifugal direction and vertical direction. Thus, only the drive forces directed in the movement direction are transmitted from the bobbin carrier drive via the bobbin carrier shoe to the bobbin carrier body.

In a further advantageous embodiment, the bobbin carrier can have a tension measuring unit and a bobbin brake with a control unit for controlling the weft thread tension. For example, the weft thread can be guided by a roller arrangement, with one of the rollers being arranged on a lever of which the bending load (caused by the weft thread tension) is measured with a strain gauge. The weft thread tension is controlled to a predetermined value via the bobbin brake.

The control unit can advantageously have a thread breakage detection unit. A thread breakage detected by the tension measuring unit can be signaled with or without contact, for example. For example, the thread breakage detection unit can have an LED which is arranged on the bobbin carrier and which lights up if there is a thread breakage. The LED is detected by a light sensor located outside the rotating part and forwarded to the machine controller, which stops the drive. Alternatively, the signaling can take place with contact.

In a further embodiment according to the present teaching, the control unit can be supplied with power via a sliding contact arrangement or via a device for electromagnetic induction.

BRIEF DESCRIPTION OF THE DRAWINGS

In the following, the present teaching shall be described in greater detail with reference to FIGS. 1 to 3, which show exemplary, schematic and non-limiting advantageous embodiments of the present teaching, and in which.

DETAILED DESCRIPTION

Figure 1:
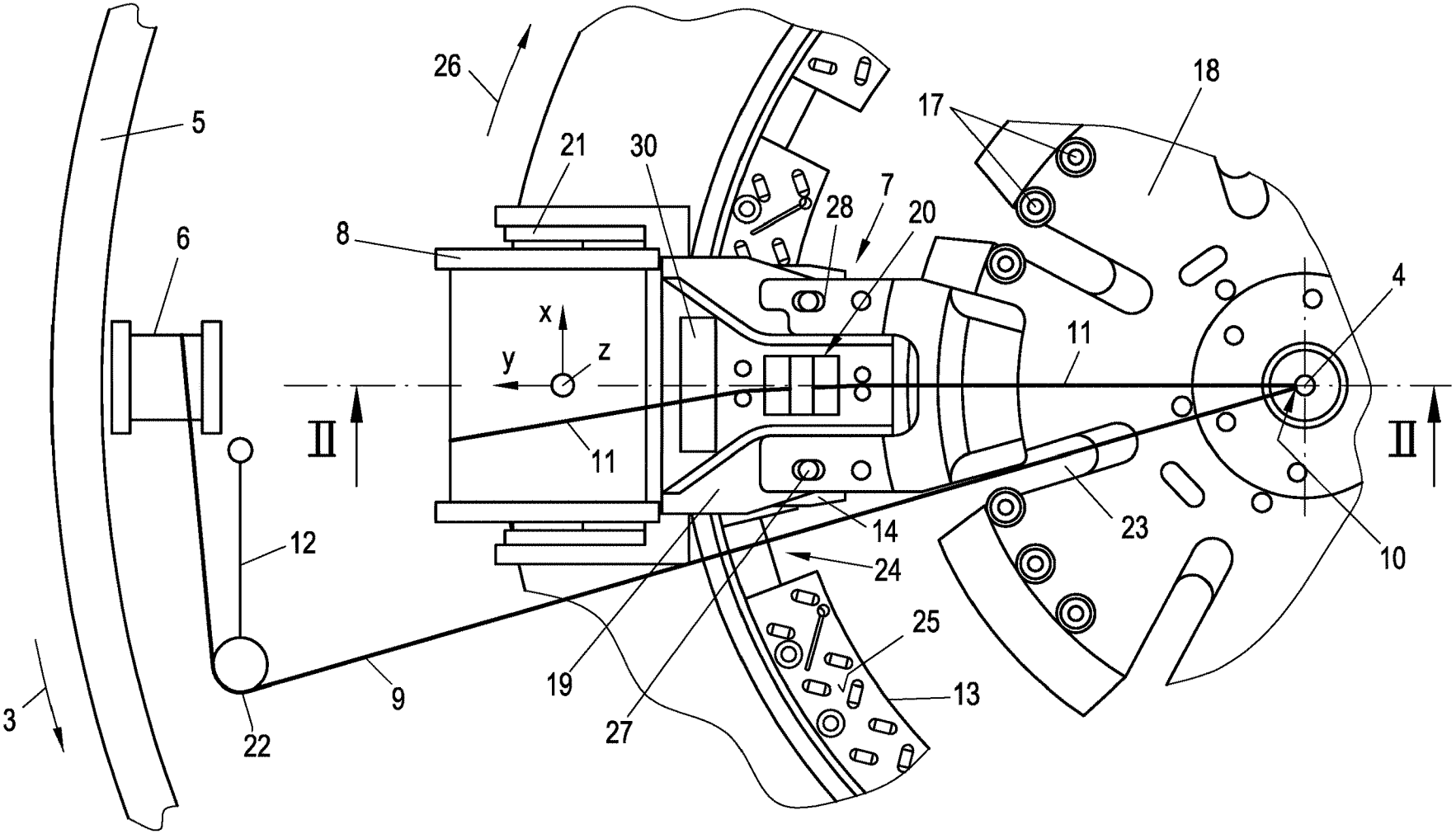
FIG. 1 shows an embodiment of the device according to the present teaching in a top view.
Figure 2:
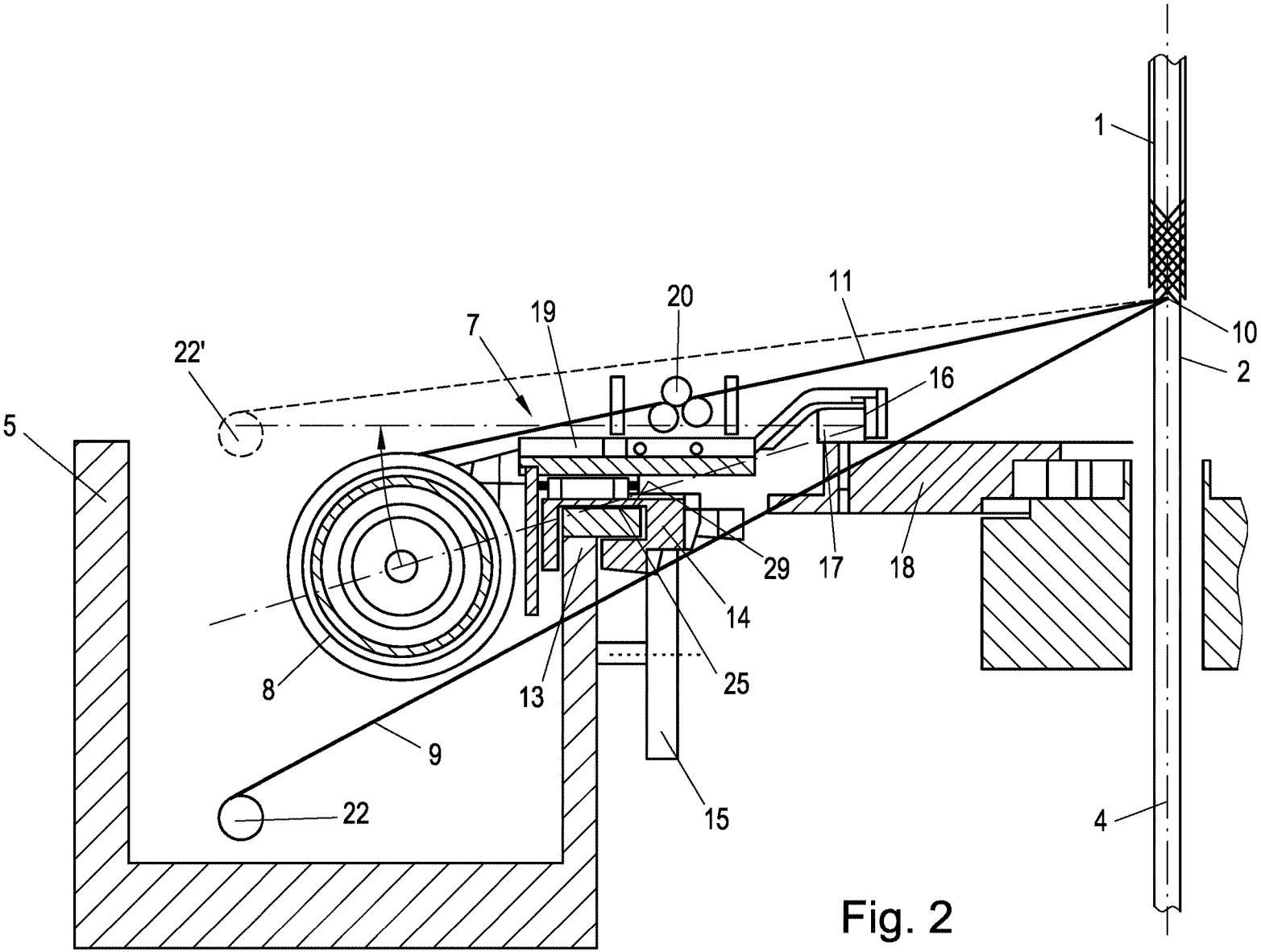
FIG. 2 shows the device in a sectional view along the line II-II shown in FIG. 1.

For reasons of clarity, FIGS. 1 and 2 each show only part of an embodiment of the device according to the present teaching for producing a braided sheath 1 around an elongate object 2. In the representations in FIGS. 1 and 2, the size ratios have been changed partly independently of one another in order to improve the representability and recognizability. The elongate object can be a cable core that is sheathed with a braided shield made of metal threads or wires, for example. However, other materials can also be used to produce the braided sheath. Unwindable materials that can be used to produce braids are generally referred to herein as "threads," regardless of the material.

The elongate object 2 is fed to the device from below along a machine axis 4 and can be unwound from a roll, for example, as is known in the field. The feed speed of the elongate object 2 is matched to the drive speed of the parts rotating about the machine axis 4. A warp thread frame 5 rotates in a warp thread rotation direction 3, with a number of warp threads 9 being unwound from warp thread bobbins 6 arranged on the warp thread frame 5 and being guided to a braiding point 10 on the elongate object 2 via a laying means 12. The laying means 12 can be designed, for example, as a lever construction known per se, with a deflection point 22 of the laying means 12 being moved back and forth between a lower position (designated as deflection point 22 in FIG. 2) and an upper position (shown in dashed lines in FIG. 2 and designated as deflection point 22') depending on the angle of rotation of the warp thread frame 5. The warp thread 9 extends in both layers from the deflection point 22 directly to the braiding point 10. The warp thread bobbin 6, the laying means 12 and the deflection point 22, 22' are only shown schematically in FIGS. 1 and 2, since they are known per se to a person skilled in the art.

In the center of the device there is a roller carrier plate 18 which rotates with the warp thread frame 5. At the edge of the roller carrier plate 18, projecting upward, a roller ring consisting of a large number of guide rollers 17 is arranged, the function of which is described below. The roller carrier plate 18 has a number of radially aligned radial slots 23 which receive the warp threads 9 in their lower position, the warp thread 9 extending below the guide rollers 17 in the lower position.

Between the roller carrier plate 18 and the position of the warp thread bobbins 6 or the laying means 12, a bobbin carrier support 13 is also provided which also rotates with the warp thread frame 5. The bobbin carrier support 13 has a plurality of vertical slots 24 which receive the warp threads 9 in their lower position, the warp thread 9 extending below a bearing surface 25 of the bobbin carrier support 13 in the lower position.

A number of bobbin threads 11 usually corresponding to the number of warp threads 9 is likewise guided to the braiding point 10 via corresponding weft thread bobbins 8, which are each arranged on a bobbin carrier 7. The bobbin carriers 7 rotate in a bobbin carrier rotation direction 26 opposite to the warp thread rotation direction 3, the course of the bobbin thread 11 remaining substantially unchanged in relation to a coordinate system (which can be defined as the centrifugal direction y, movement direction x and vertical direction z) rotating with the bobbin carrier 7. The bobbin thread 11 extends below the upper position of the warp thread 9 and above the lower position of the warp thread 9. By now laying the warp thread 9 alternately above and below the weft thread 11 rotating past in the opposite direction via the laying means 12, the braided sheath 10 is formed at the braiding point 10. If necessary, a plurality of threads from a single warp thread bobbin 6 and/or weft thread bobbin 8 can also be fed simultaneously to the braiding point 10. Alternating above and below the weft thread 11 does not necessarily mean that the laying means 12 moves the warp thread 9 upward (or downward) after each weft thread 11 from each weft thread bobbin 8. The laying means 12 could of course also change the position of the warp thread 9, for example after every second or every fourth weft thread bobbin 8 rotating past. This largely depends on the desired braided pattern. Corresponding braided patterns and methods for their production are known in the art.

Even though FIG. 1 only shows the course of a single warp thread 9 and a single weft thread 11, it can be seen that, for practical implementation, a large number of warp threads 9 and weft threads 11 are guided to the braiding point 10 via corresponding warp thread bobbins 6 and bobbin carriers 7. For example, in the embodiment shown, eight warp threads can be guided to the braiding point 10 and the same number of bobbin carriers 7 can be provided.

Each bobbin carrier 7 substantially consists of a weft thread bobbin 8 on which the weft thread 11 (or a plurality of weft threads 11) is wound, and a bobbin carrier body 19, at the radially outer end of which the weft thread bobbin 8 is arranged and at the radially inner end of which a guide surface 16 is arranged which abuts the inside of the guide rollers 17 of the roller ring on the roller carrier plate 18. On the underside of the bobbin carrier body 19, a bobbin carrier shoe 14 is arranged which establishes a connection with a bobbin carrier drive 15. The bobbin carrier drive 15 can be a known arrangement of gears which engage with teeth provided on the bobbin carrier shoe 14. The gears of the bobbin carrier drive 15 can be arranged on the warp thread frame 5 and rotate therewith, or they can be arranged on a unit detached from the warp thread frame 5 and can possibly be driven by the rotation of the warp thread frame 5 (or by parts rotating therewith) via corresponding toothed connections. The gears of the bobbin carrier drive 15 move the bobbin carrier shoes 14 in a bobbin carrier rotation direction 26 opposite to the warp thread rotation direction 3, the bobbin carrier shoes 14 in turn moving the bobbin carrier bodies 19 with them. The rotational speed of the bobbin carriers 7 is matched to the rotational speed of the warp thread frame 5 in order to coordinate the up and down movement of the deflection points 22, 22' of the warp threads 9 with the bobbin carriers rotating past in the opposite direction.

A tension measuring unit 20 is provided on the upper side of the bobbin carrier body 19 and measures the tensile stress acting on the weft thread 11. The tension measuring unit 20 can, for example, consist of a roller arrangement with three rollers arranged so as to be offset from one another, through which the weft thread 11 is guided in such a way that the central roller is pressed outward by the weft thread tension. The central roller is mounted on a lever to which a strain gauge is fastened for measuring the pressure on the roller and thus the weft thread tension is measured. For the sake of clarity, these parts are not shown in detail in FIGS. 1 and 2. In a protected region of the bobbin carrier 7, for example below the bobbin carrier body 19 or integrated in the bobbin carrier body 19, a control unit 30 is arranged which evaluates the signals from the tension measuring unit 20 and, according to known control algorithms, generates a brake signal for a bobbin brake 21 in order to keep the tensile stress of the weft thread 11 in a set range. The control unit 30 and the bobbin brake 21 can cover their power requirements via a power supply (not shown) which can be fed for example via sliding contacts. The sliding contacts can be arranged, for example, in the region of the bobbin carrier support 13, the bobbin carrier 7 having corresponding pick-ups that briefly come into contact with the sliding contacts as they rotate past, with a current pulse being transmitted which feeds the power supply. Alternatively, the power supply units of the bobbin carriers can also be contactless, for example with magnetic induction coils which are arranged on the bobbin carrier and are moved by the magnetic field of oppositely rotating or stationary magnets, so that electromagnetically induced current flows through the induction coil.

The control unit 30 can also easily detect a thread breakage if the tensile stress suddenly drops to zero. This can be signaled to the machine controller, and contact-based and contact-free signaling methods can be used for this. For example, a signal can be transmitted via sliding contacts, or a radio or light signal can be transmitted. For example, a simple LED can be provided on the bobbin carrier 7, which lights up if there is a thread breakage. A detection device provided on the machine detects the light signal and transmits a signal to the machine controller, which stops the device.

Of course, control of the warp thread tension could also be implemented in an analogous manner for the warp thread(s) 9; a separate representation in the figures has been omitted for reasons of clarity. The control unit 30 could be used for this purpose, for example, or a separate control unit could also be provided. The control unit 30 or the separate control unit would then control the tensile stress of a warp thread 9 in a known manner. Of course, this would again require a corresponding tension measuring unit to determine the warp thread tension, i.e. the tensile stress acting in the warp thread 9, as well as a bobbin brake for the warp thread bobbin 6, each of which would have to be provided at a suitable point on the warp thread frame 5. The tension measuring unit for the warp thread 9 can be designed e.g., as described above. If a plurality of warp thread bobbins 6 is provided, the control unit can of course also be used to control the warp thread tension of a plurality of warp threads 9.

The bobbin carrier shoe 14 is connected to the bobbin carrier body 19 with play, with a relative movement of the bobbin carrier body 19 with respect to the bobbin carrier shoe 14 being possible in the centrifugal direction y and the vertical direction z, or generally along two axes in the plane arranged transversely to the movement direction x. This can be done, for example, by one or more bolts 27 which engage in elongate holes 28 arranged transversely to the movement direction x. The bolts 27 can be arranged so as to project upward on the bobbin carrier shoe 14, with the elongate holes being arranged in the bobbin carrier body 19, or vice versa. As a result of this arrangement with play, the drive forces are transmitted to the bobbin carrier body 19 only in the desired drive direction (i.e., in the movement direction x). In the centrifugal direction y, the bobbin carrier body 19 is held only by the guide surface 16, which abuts the guide rollers 17 which absorb the centrifugal forces.

The bobbin carrier shoe 14 is arranged on the bobbin carrier support 13, the bobbin carrier shoe 14 having at least one sliding surface 29 which is arranged opposite at least one bearing surface 25 of the bobbin carrier support 13. However, the sliding surface 29 of the bobbin carrier shoe 14 rests on the bearing surface 25 only when the device is at a standstill and slides on it only for a short time while the machine is starting up. The bobbin carrier 7 and the guide rollers 17 are in particular designed in such a way that the bearing force of the bobbin carrier 7 on the bearing surface 25 of the bobbin carrier support 13 is reduced to zero as soon as the rotational speed exceeds a specified speed, and in particular while the machine is running at operating speed. Since no bearing force then acts normally on the bearing surface 25 of the bobbin carrier support 13, i.e., in the vertical direction z in FIG. 1, an air gap forms between the sliding surface 29 and the bearing surface 25, which air gap is only very narrow but prevents any sliding friction. The formation and stability of the air gap can be facilitated by the shape of the bobbin carrier shoe 14 and, if necessary, additional aids can be provided to ensure the air gap, such as air nozzles in the bearing surface 25 and/or pairs of magnets which pull or repel the bobbin carrier shoe 14 upward. However, since there is no relevant contact pressure between the bobbin carrier 7 and the bobbin carrier support 13, occasional slight contact and grinding of the parts would also be unproblematic due to the low relative forces.

In order to ensure by design that the bearing forces become zero from a specified speed, the following parameters in particular must be selected appropriately:

- The position of the bobbin carrier support 13 and the inclination of the bearing surface 25,
- The position and, if applicable, axis inclination of the guide rollers 17
- The outer contour of the guide rollers 17 (or the corresponding shape of the guide surface), The center of gravity of the bobbin carrier 7 and the change in the center of gravity between a full weft thread bobbin 8 and an empty weft thread bobbin 8.

These parameters are to be selected such that, when the bobbin carrier 7 rotates about the machine axis 4, an equilibrium of the forces acting on the bobbin carrier 7 is established. The forces to be considered are:

The force of gravity FS which acts in the negative z direction due to the weight of the bobbin carrier 7 and extends through the center of gravity, The centrifugal force FZ which is dependent on the speed of rotation and the weight of the bobbin carrier 7 and also extends through the center of gravity and acts in the y direction, The guiding force FF applied by the guide rollers 17 to the guide surface 16, The tensile force of the weft thread, on the other hand, is irrelevant due to its low intensity and can be dismissed.

The force of gravity FS and the centrifugal force FZ can be considered to be a resultant force FR which is directed obliquely outward and downward in the y-z plane. It should be noted that the inclination of this resultant does not change if the speed of rotation remains constant and the weight changes, since the centrifugal force and the force of gravity both depend on the weight and thus (provided that the speed of rotation is always constant) are in a fixed relationship to each other. The weight changes in particular when the weft thread 11 is steadily unwound from the weft thread bobbin 8 and the weft thread bobbin 8 becomes lighter.

In particular, the forces are in equilibrium when the line of action of the resultant force FR coincides with the line of action of the guiding force FF and the two forces are opposite. The calculation and design of specific embodiments of the device according to the present teaching are, with knowledge of the teachings disclosed herein, within the ability of an average person skilled in the art.

Figure 3:
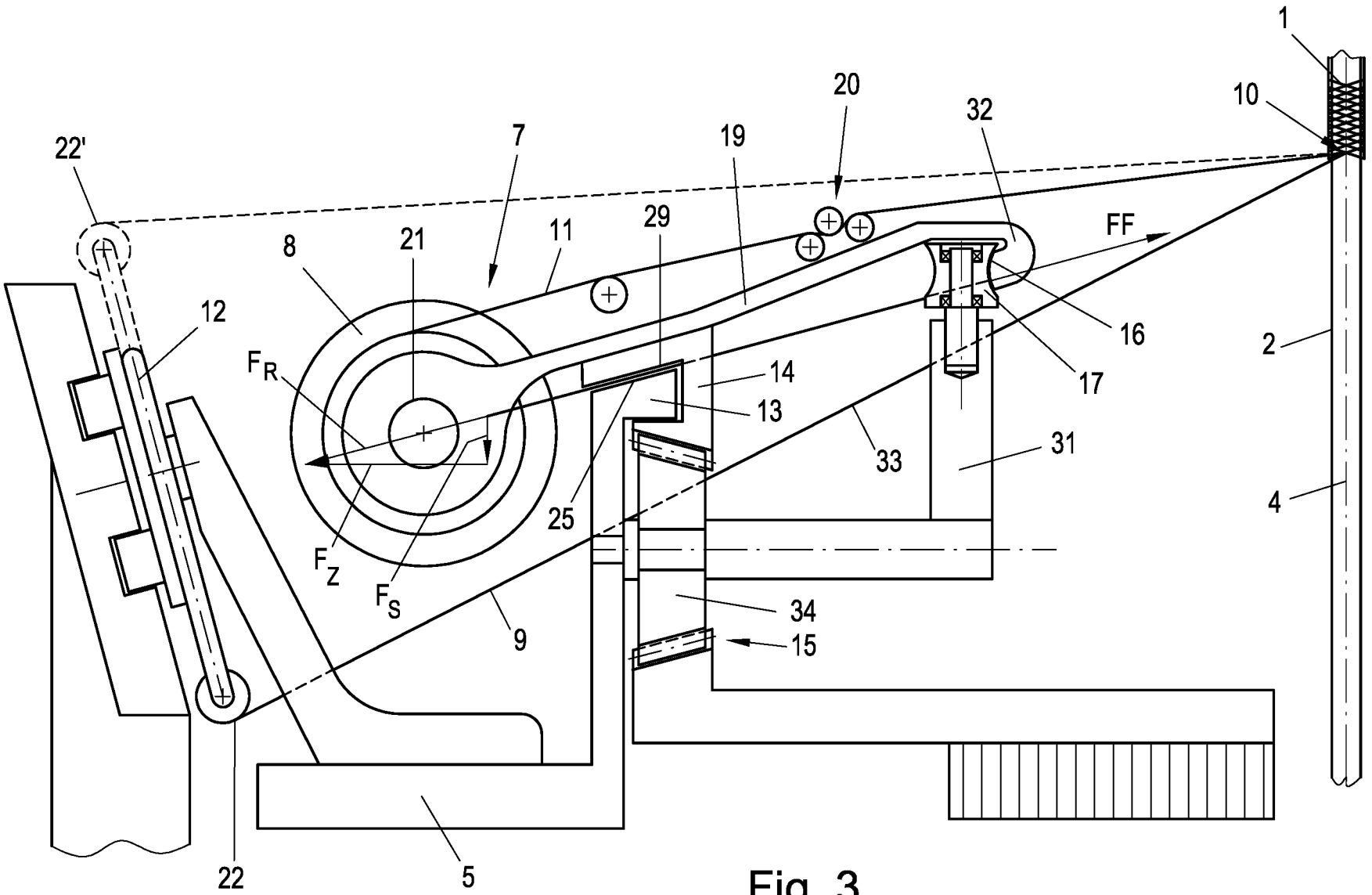
FIG. 3 shows a further embodiment of the device according to the present teaching in a sectional view.

FIG. 3 shows a further exemplary embodiment of the device according to the present teaching in a vertical sectional view transverse to the movement direction, i.e., along the y-z plane. For the sake of comparability and for better understanding, elements that correspond to the parts already described are provided with identical reference signs.

The device shown in FIG. 3 has a warp thread frame 5 rotating in the warp thread rotation direction 3 with warp thread bobbins 6 (not shown in FIG. 3). A warp thread 9 is guided from each warp thread bobbin 6 via a laying means 12 to a braiding point 10 which lies on an elongate object 2 guided along a machine axis 4. Depending on the angle of rotation of the warp thread frame 5, a deflection point 22 of the laying means 12 is moved back and forth between a lower position (deflection point 22) and an upper position (deflection point 22'—shown in dashed lines).

On the warp thread frame 5, a bobbin carrier support 13 is in turn arranged in a position lying radially inside the laying means 12, which support in this case has a bearing surface 25 which is inclined obliquely outward. The bobbin carrier shoes 14 of the bobbin carrier 7 rotating in an opposite manner to the bobbin carrier support 13 are arranged on the bobbin carrier support 13, the bobbin carrier shoes 14 in turn having a sliding surface 29 which is arranged in parallel with the bearing surface 25. As soon as a specified speed is exceeded, an air gap is in turn formed between the sliding surface 29 and the bearing surface 25, so that no sliding friction occurs. The bobbin carrier shoes 14 are driven via the gears of a bobbin carrier drive 15 and the bobbin carrier shoe 14 is connected with play to a bobbin carrier body 19 of the bobbin carrier 7 in a manner analogous to the previously described embodiment, with a relative movement of the bobbin carrier body 19 with respect to the bobbin carrier shoe 14 being possible in the centrifugal direction y and the vertical direction z, or generally along two axes in the plane arranged transversely to the movement direction x.

The bobbin carrier drive 15 has a large number of bevel gears 34 which (leaving the slots for the warp threads 9 free) are arranged circumferentially inside and below the bobbin carrier supports 13. The shafts of the bevel gears 34 are mounted on the warp thread frame 5 so as to rotate therewith and are driven by corresponding gear arrangements in order to drive the bobbin carrier shoes 14 in the bobbin carrier rotation direction 26, the speed being synchronized with the movements of the laying means 12.

Radially inside and slightly above the bobbin carrier support 13 is a roller ring consisting of a large number of guide rollers 17, whereby, instead of a roller carrier plate, in the embodiment of FIG. 3 a roller carrier 31 is provided which is fastened to the warp frame 5 and rotates therewith and on the top of which the guide rollers 17 are mounted. Slots are provided both on the bobbin carrier support 13 and on the roller carrier 31, in which slots the warp threads are received in their lower position (i.e., between the lower deflection point 22 and the braiding point 10).

The guide rollers 17 have a profiled contour with a concave lateral surface. A profiled contour of the guide rollers 17 is in contact with a correspondingly designed profiled guide surface 16 which is provided on a hook-like formation 32 on the bobbin carrier body 19. The curvature of the guide surface 16 can have a radius that matches the radius of curvature of the concave lateral surface or a slightly smaller radius. Instead of a circular curvature, a more complex curvature shape can also be used. The profiled contour of the guide rollers 17 or the guide surface 16 allows a guide force FF to be applied from the guide rollers 17 to the bobbin carrier 7, the angle of which is adapted to the course of the line of action 33 of the oppositely acting resultant FR from gravity FS and centrifugal force FZ. The line of action 33 extends in parallel with the bearing surface 25 of the bobbin carrier support 13 or the sliding surface 29 of the bobbin carrier shoe 14.

In the embodiment shown, the outwardly curved guide surface is mounted on the concave lateral surfaces of the guide rollers 17, but other profiles can also be used, for example convex lateral surfaces in conjunction with inwardly curved guide surfaces, or also V profiles.

The bobbin carrier 7 has a tension measuring unit 20 for the weft thread bobbin 8 and a bobbin brake 21 arranged on the weft thread bobbin 8, the mode of operation of which is analogous to the previously described embodiment.

The invention claimed is:

1. A device for producing a braided sheath around an elongate object, the device having;

a warp thread frame which rotates in a warp thread rotation direction about a machine axis and has a group of warp thread bobbins, a group of bobbin carriers which rotate in the opposite direction about the machine axis and each have at least one weft thread bobbin, with at least one warp thread being guided from each warp thread bobbin to a braiding point, and at least one weft thread being guided from each weft thread bobbin to the braiding point, such that the course of the warp thread can be shifted alternately above and below the weft thread rotating past in the opposite direction, wherein the device has a bobbin carrier support rotating with the warp thread frame in the warp thread rotation direction during operation, the bobbin carriers being mounted on the bobbin carrier support when the machine is at a standstill and the bobbin carriers being dimensioned so that the bearing force on the bobbin carrier support becomes zero when a specified speed is exceeded, wherein the bobbin carriers have a bobbin carrier shoe, on which a bobbin carrier drive engages, and a bobbin carrier body, which holds the weft thread bobbin, wherein the bobbin carrier shoe and the bobbin carrier body are interconnected such that they can be shifted in centrifugal direction and vertical direction.

2. The device according to claim 1, wherein at the end closest to the machine axis, the bobbin carriers have a guide surface which is oriented in centrifugal direction and which is mounted on a roller ring having guide rollers which are arranged on a roller carrier plate.

3. The device according to claim 2, wherein the guide rollers have a convex or concave outer contour.

4. The device according to claim 1, wherein the bobbin carrier has a tension measuring unit and a bobbin brake with a control unit for controlling the weft thread tension.

5. The device according to claim 4, wherein the control unit has a thread breakage detection unit for detecting a thread breakage in the weft thread and/or the warp thread.

6. The device according to claim 4, wherein a power supply of the control unit includes a sliding contact arrangement or a device for electromagnetic induction.

7. The device according to claim 1, wherein the warp thread frame has a tension measuring unit for measuring a warp thread tension of a warp thread and a bobbin brake for the warp thread bobbin assigned to the warp thread, with a control unit to regulate the warp thread tension.

8. The device according to claim 1, wherein the course of the warp thread is shifted alternately above and below the weft thread rotating past in the opposite direction via a laying means.

* * * * *